US010413774B2

(12) United States Patent
Weber

(10) Patent No.: US 10,413,774 B2
(45) Date of Patent: Sep. 17, 2019

(54) LEG EXERCISE WEIGHTED SHOE ASSEMBLY

(71) Applicant: Alex Weber, College Station, TX (US)

(72) Inventor: Alex Weber, College Station, TX (US)

( * ) Notice: Subject to any disclaimer, the term of this patent is extended or adjusted under 35 U.S.C. 154(b) by 196 days.

(21) Appl. No.: 15/412,237

(22) Filed: Jan. 23, 2017

(65) Prior Publication Data

US 2017/0216651 A1 Aug. 3, 2017

Related U.S. Application Data

(60) Provisional application No. 62/288,737, filed on Jan. 29, 2016.

(51) Int. Cl.

| | |
|---|---|
| ***A63B 21/065*** | (2006.01) |
| ***A63B 21/00*** | (2006.01) |
| ***A63B 21/06*** | (2006.01) |
| ***A63B 23/04*** | (2006.01) |

(52) U.S. Cl.

CPC ..... *A63B 21/065* (2013.01); *A63B 21/0004* (2013.01); *A63B 21/00061* (2013.01); *A63B 21/00065* (2013.01); *A63B 21/0601* (2013.01); *A63B 21/4025* (2015.10); *A63B 21/4043* (2015.10); *A63B 23/04* (2013.01); *A63B 2209/00* (2013.01)

(58) Field of Classification Search

CPC ... A63B 21/065; A63B 23/04; A63B 21/4043; A63B 21/4025; A63B 21/00065; A63B 21/00061; A63B 21/0004; A63B 21/0601; A63B 2209/00

See application file for complete search history.

(56) References Cited

U.S. PATENT DOCUMENTS

| | | | | | |
|---|---|---|---|---|---|
| 2,700,832 | A * | 2/1955 | Slovinski | A43B 7/1465 | 36/132 |
| 3,517,928 | A * | 6/1970 | Shanahan | A43B 3/0031 | 36/132 |
| 3,628,262 | A * | 12/1971 | Stopek | A43B 3/00 | 36/7.5 |
| 3,785,646 | A * | 1/1974 | Ruskin | A43B 3/0031 | 36/132 |
| 4,106,771 | A * | 8/1978 | Fern | A63B 69/3673 | 36/139 |
| 4,457,084 | A * | 7/1984 | Horibata | A43B 5/12 | 36/28 |
| 4,458,432 | A * | 7/1984 | Stempski | A43B 5/06 | 36/132 |
| 4,774,776 | A * | 10/1988 | Gulli | A43B 5/18 | 36/132 |
| 5,231,776 | A * | 8/1993 | Wagner | A43B 19/005 | 36/1 |

(Continued)

*Primary Examiner* — Garrett K Atkinson

(74) *Attorney, Agent, or Firm* — Douglas Baldwin; Timothy Snowden

(57) ABSTRACT

Disclosed are weighted shoe assemblies that allows easy selection of different weights and the ability to accommodate a variety of foot or shoe sizes. This greatly reduces the cost of providing all sizes and shapes of individually fitted shoes. More specifically disclosed are weighted shoe assemblies having an upper attachment component to attach to a user's foot or shoe and a removable weight components to allow selection of desired weights and means to removably attach the components together.

6 Claims, 5 Drawing Sheets

(56) References Cited

U.S. PATENT DOCUMENTS 5,267,927 A * 12/1993 Catanzano ..... A63B 21/065 482/105
5,423,136 A * 6/1995 Gulli ..... A43B 5/18 36/132
5,475,935 A * 12/1995 Frost ..... A43B 7/20 36/114
D368,289 S * 3/1996 Cotten ..... D21/683
5,542,896 A * 8/1996 Qaiesi ..... A43B 19/005 482/105
5,683,335 A * 11/1997 Groves ..... A43B 19/005 482/105
5,722,919 A * 3/1998 Timmer ..... A63B 21/0004 482/105
5,728,032 A * 3/1998 Glass ..... A43B 5/00 36/132
5,779,557 A * 7/1998 Scannell ..... A63B 69/3667 473/269
5,893,223 A * 4/1999 Glass ..... A43B 5/00 36/132
5,901,473 A * 5/1999 Heifort, IV ..... A43B 5/00 36/132
5,935,047 A * 8/1999 Cawley ..... A63B 21/4015 36/132
6,005,041 A * 12/1999 Cook ..... A63B 21/06 524/435
6,010,438 A * 1/2000 Fitzgerald ..... A63B 21/065 36/132
6,052,924 A * 4/2000 Sabat ..... A43B 3/0031 36/132
6,551,225 B1 * 4/2003 Romero ..... A63B 21/0004 482/145
7,000,337 B2 * 2/2006 Harrington ..... A43B 5/00 36/132
7,500,324 B1 * 3/2009 Power ..... A43B 13/145 36/132
7,770,930 B2 * 8/2010 McLeod ..... A63B 21/065 280/11.12
7,794,368 B2 * 9/2010 Rutherford ..... A43B 5/00 482/129
7,833,137 B2 * 11/2010 Garnuette ..... A63B 21/06 36/132
8,826,571 B2 * 9/2014 Rutherford ..... A43B 3/00 36/136
9,017,231 B2 * 4/2015 Kosich ..... A63B 21/065 482/105
9,132,316 B2 * 9/2015 Lima ..... A63B 23/1236
9,522,295 B2 * 12/2016 Annino ..... A63B 21/065
2005/0252042 A1 * 11/2005 Harrington ..... A43B 5/00 36/132
2009/0107010 A1 * 4/2009 Rutherford ..... A43B 5/00 36/132
2010/0050477 A1 * 3/2010 Zeek ..... A43B 5/00 36/132
2010/0192419 A1 * 8/2010 Jack ..... A43B 1/0054 36/132
2010/0210428 A1 * 8/2010 Garnuette ..... A63B 21/06 482/105
2011/0258885 A1 * 10/2011 Rutherford ..... A43B 3/00 36/136
2012/0028767 A1 * 2/2012 Zeek ..... A63B 21/065 482/105
2012/0088640 A1 * 4/2012 Wissink ..... A63B 21/0726 482/110
2012/0225757 A1 * 9/2012 Kosich ..... A63B 21/065 482/105
2013/0196829 A1 * 8/2013 Elbaz ..... A43B 5/00 482/79
2014/0100090 A1 * 4/2014 Lima ..... A63B 23/1236 482/139
2016/0256732 A1 * 9/2016 Kasner ..... A63B 21/4015
2016/0345656 A1 * 12/2016 Ramirez, II ..... A43B 5/18
2017/0106225 A1 * 4/2017 Bores Cifo ..... A63B 21/16
2018/0036577 A1 * 2/2018 Leary ..... A63B 21/065

* cited by examiner

LEG EXERCISE WEIGHTED SHOE ASSEMBLY

CROSS REFERENCE TO RELATED APPLICATIONS

This application claims benefit of Provisional Patent Application Ser. No. 62/288,737, filed Jan. 29, 2016, the contents and disclosure of which is incorporated herein by reference in its entirety for all purposes.

BACKGROUND

Field of Invention

This invention relates to weighted leg exercise structures for enhancing exercise and training. More particularly, the invention relates to structures that have removable, selectable weight component(s) for enhancing exercise and training.

Background

The benefits of ankle weights and weighted-shoes to enhance the exercise experience is well known. There are numerous weighted leg exercise structures commercially available, and the internet is replete with instructions on the various exercises that can be used with these weights. Most commercially available weighted-shoes consist of weights that can be that come already weighted.

BRIEF SUMMARY OF INVENTION

The present invention provides a weighted-shoe assembly that allows for easy selection of different weights as well as the ability to accommodate a variety of foot or shoe sizes, which greatly reduces the cost of providing all sizes and shapes of individually fitted shoes.

In broad scope, the invention is a weighted-shoe assembly with an upper attachment component that fastens to a user's foot or shoe and a removable weight component that allows for the selection of desired weights. In addition, the invention includes means to removably attach the components together.

DETAILED DESCRIPTION

Figure 1:
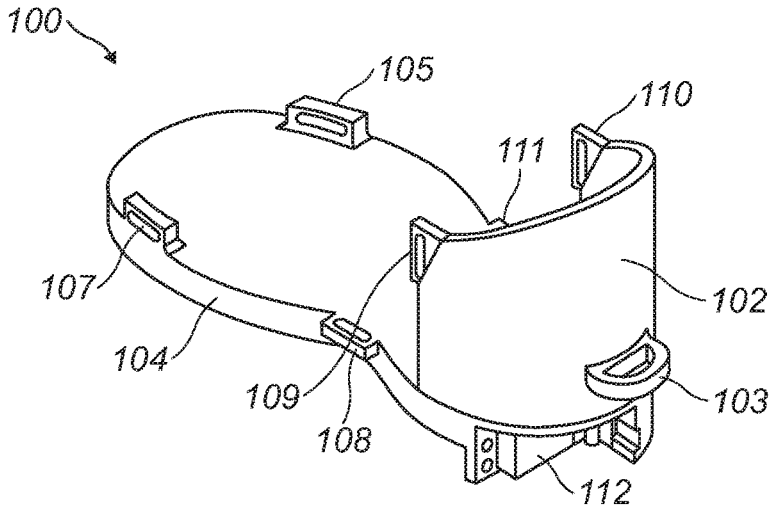
FIG. 1 is a perspective view of the top attachment component of an embodiment of the invention.
Figure 2:
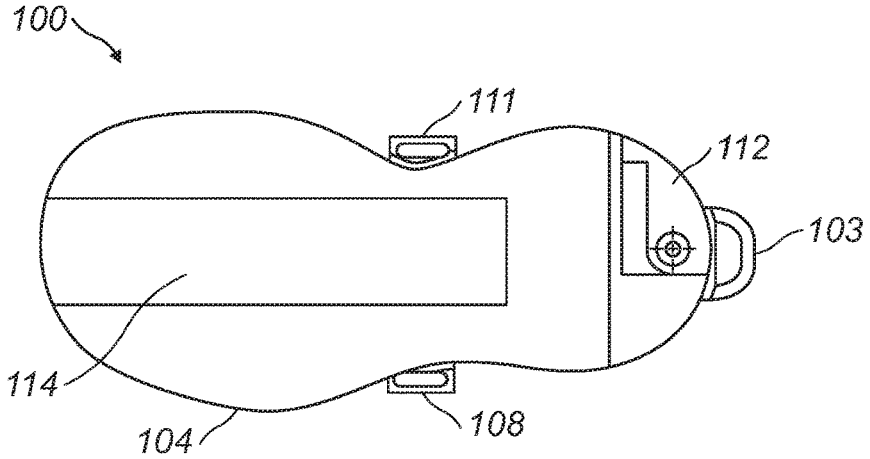
FIG. 2 is a bottom view of the top attachment component of an embodiment of the invention.
Figure 3:
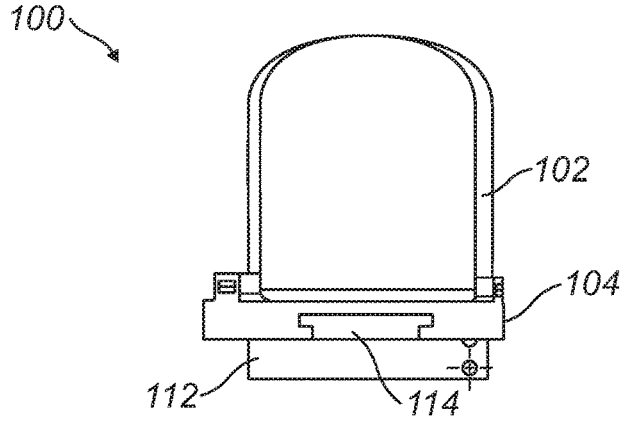
FIG. 3 is an end view of the top attachment component of an embodiment of the invention.
Figure 4:
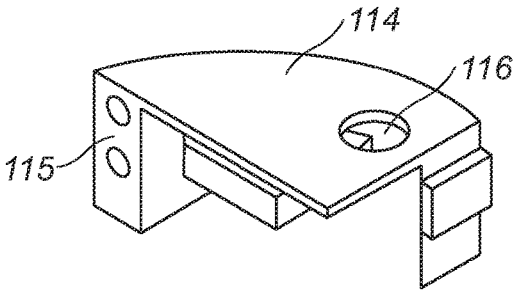
FIG. 4 is a perspective view of an attachment mechanism component of an embodiment of the invention.
Figure 5:
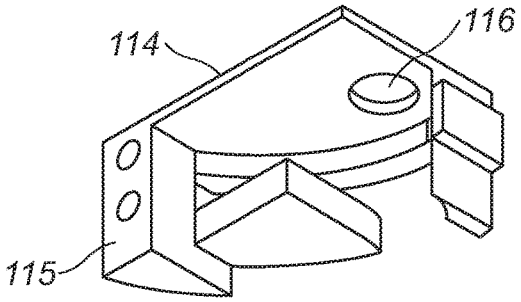
FIG. 5 is a perspective view of an attachment mechanism of an embodiment of the invention.
Figure 6:
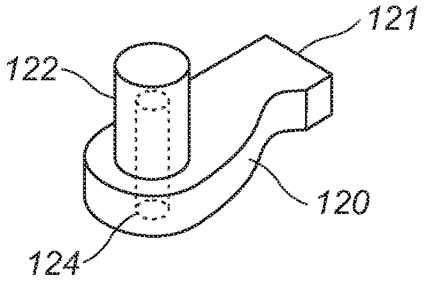
FIG. 6 is a perspective view of an attachment pin of an embodiment of the invention.
Figure 7:
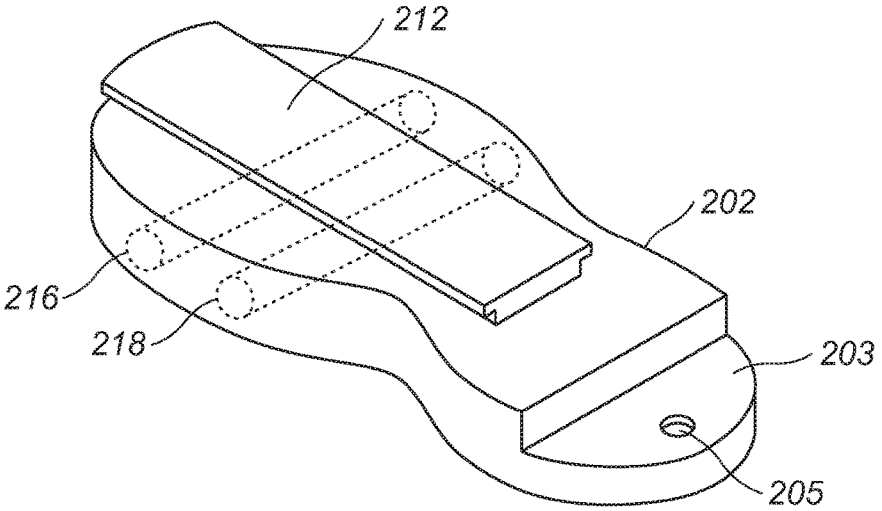
FIG. 7 is a perspective view of the bottom weight attachment component of an embodiment of the invention.

An embodiment of the invention is illustrated in FIGS. 1-8. FIGS. 1-3 illustrate the top attachment component. FIGS. 4 and 5 illustrate the weight component attachment mechanism, and FIG. 6 shows the weight bottom component. FIG. 7 illustrates the way in which the components fit together.

Referring to FIGS. 1-3, FIG. 1 is a perspective view of the top attachment component, 100. It comprises a base 104, back heel support 102, and a location on the rear, 112, for attachment of the weight attachment mechanism 114 (FIGS. 4 and 5). This component has the approximate shape of the sole of a human shoe (or foot) with a heel end and toe end. The upper side of the top attachment component may also have cushioning or shock-absorbing pads disposed therein. Optionally, there are raised connecting slots 105, 107, 108, 109,110, and 111. Item 103 is an optional carabiner connection for hanging the shoe with a carabiner clip. The shoe has a slot, 114, running from front to back to mate with a projection 212 in the weight component 200. The slot is shown with a smaller outer opening and expanded upper opening, but other configurations, such as a slot with sloped sides, are within the scope of the invention. Other means of connecting the top component and bottom weight component may also be uses. The upper component may be attached to the lower component with straps or with a sheet of hook-and-loop connectors. One half of a hook-and-loop sheet would be attached to the underside of the upper component and the other half to the top side of the lower component. A recess in the bottom side of the top or top of the lower component with a matching recess in the other component could be used to orient the component being attached. Alternatively, the upper and lower components may be connected by snaps or by nuts and bolts. Alternatively there can be walls on the top side of the lower component or bottom side of the upper component that extend over the sides of the other component. The components could then be attached by snap, hook-and-loop straps, nuts and bolts in the inside of the wall and outside wall of the other component.

The base, 104, is preferably made of any suitable such as wood, metal, or polymer. Polymer material(s) such as polystyrene, PVC, polypropylene, polyethylene, polyurethane, dense, and flexible hydrogel or similar engineering polymers are suitable. Polyurethane is especially suitable as it is easily molded and tailored for hardness and durability.

The back heel support 102 may be made of the same material as the base but also may be made of fabric or a flexible polymer sheet. In use, a user's foot or shoe will fit into the top attachment component and be secured by straps connected to the raised connecting slots 105, 107,108, 109,110, and 111. Flexible fabric or polymer straps may be used by inserting them into the raised connecting slots. Straps with a Velcro™ type hook and loop strap pieces are very suitable. Attachment of the foot or shoe may also be made with straps or cords attached directly to the sides of the base 104 and back heel support without the need for the raised connecting slots. The straps or cords may be made integral with or attached to the base and back heel support. Other means such as those used to attach skates to shoes and ski boots to skis may be adapted for use in attaching the upper component to user's shoes and are also suitable. A significant advantage of the present structure is that with only 3-4 sizes, the shoes will accommodate the entire range of user shoe (or foot) sizes, whereas a multiple number of shoe sizes are needed for other weighted shoes.

Figure 8:
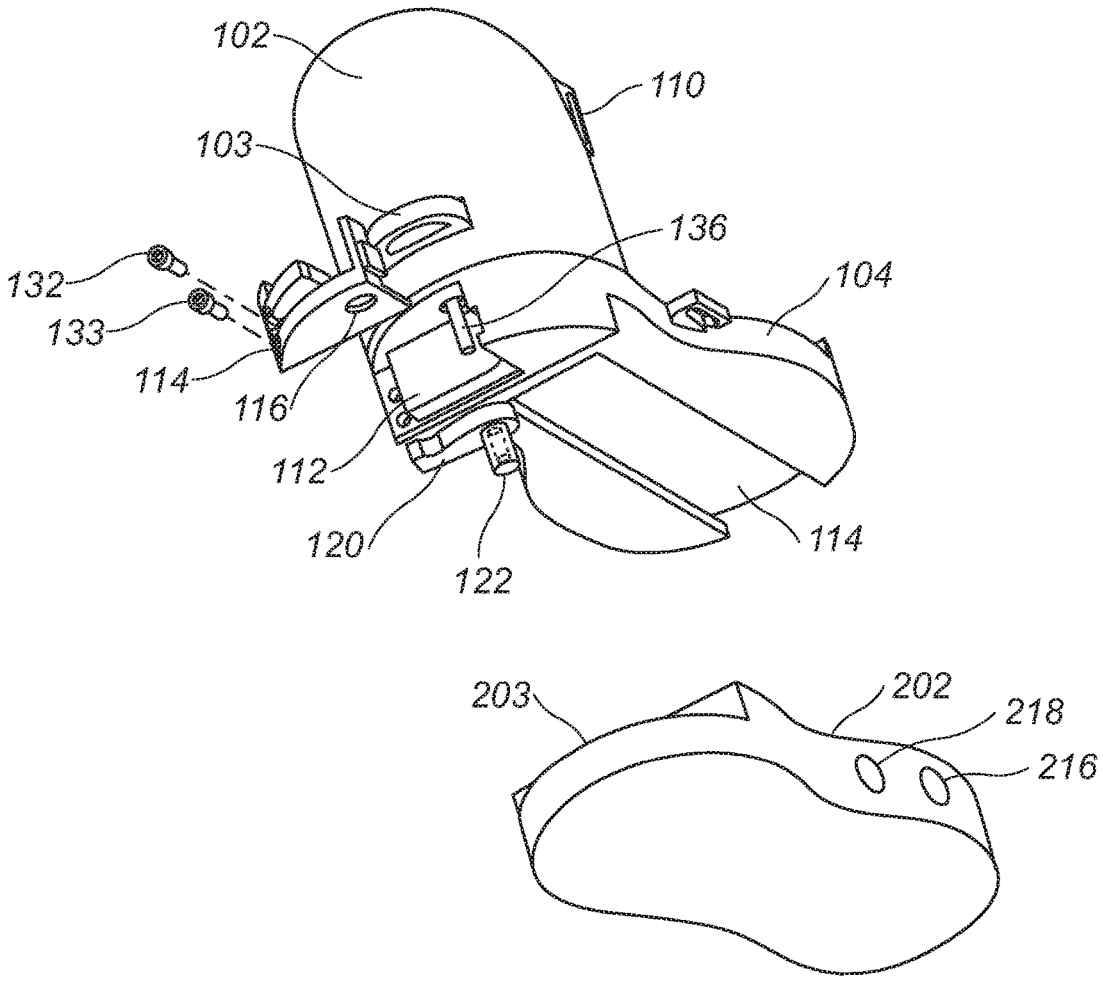
FIG. 8 is a perspective view of an embodiment of the invention showing how the components fit together.

A quick attach/release attachment mechanism to allow secure attachment of the top component to the bottom weight component is illustrated in FIGS. 4 and 5 and an attachment pin in FIG. 6. The mechanism has screw holes 115 through which screws are placed to secure the mechanism to the rear of the top attachment component at 112. The mechanism 114 has an opening 116 through which a pin 122 (FIG. 6) is placed. Referring to FIG. 6, there is shown the lockin pin 120 having a shaped body 121 and pin 122. There is an opening, 122, in the pin 120 for a coiled spring. The pin is placed in the attachment a mechanism 114 and a coiled spring in the opening 122. When in place, this allows the pin to be pushed upward so as not to project beyond the lower face of the base 104 where the opening fits over pin 136 (FIG. 8). When the weight component (FIGS. 7 and 8) is attached to the top component, the pin can be released and the spring forces it downward through the opening 205 in the bottom weight component. This locks the top and bottom weight components together. The bottom weight component has a projection 212 on the top side that is mated to the opening 114 on the bottom of the top attachment component. The component 201 provides the selectable, removable weight for the shoe assembly. The weight is varied by the nature and thickness of the material of the weight base 202. Various sizes and weight of bottom weight component are provided. Additionally the weight component may have added weight(s) inserted in optional slots, 216 and 218 in the base. The slots or holes may be any suitable shape and will allow inserts (shaped and sized to fit inside the slots) that are of greater density than the base material of the weight component. For example, the weight component is preferably constructed of a polymer material (polyurethane preferred), and the inserts made of metal, such as steel or lead. Thus, there are many degrees of freedom in adjusting the weight of the bottom weight component. The component locking system is an example of an embodiment and not limiting. Other means of locking the components are considered within the scope of the invention.

As shown, the weight component has a flat unpatterned bottom surface. However, it may be patterned with ridges, grooves, names, and logos. A patterned bottom will enhance the ability to walk in the shoe assembly and reduce the chance of sliding and slipping.

FIG. 8 illustrates the way in which the components fit together for use. The attachment mechanism 112 is secured to the top attachment component 200 with screws 132 and 133. The connecting pin system 120 is lifted and the weight component is slid into place with the projection of the weight component into the slot in the top component 114. The pin system is released and the coiled spring forces the pin down into the opening 205 in the weight component.

Another set of embodiments is illustrated in FIGS. 9-12. In broad aspect, the second set of embodiments is an assembly comprised of a top platform and bottom platform. The platforms attach together by an adjustable latch system that connects the platforms when stacked. Pressure from the mass of the top platform depresses the latch to connect with latch-receiving prongs in the bottom platform. Intermediate platforms, each having a similar latch system, may be stacked to add additional weight to the assembly.

Figure 9:
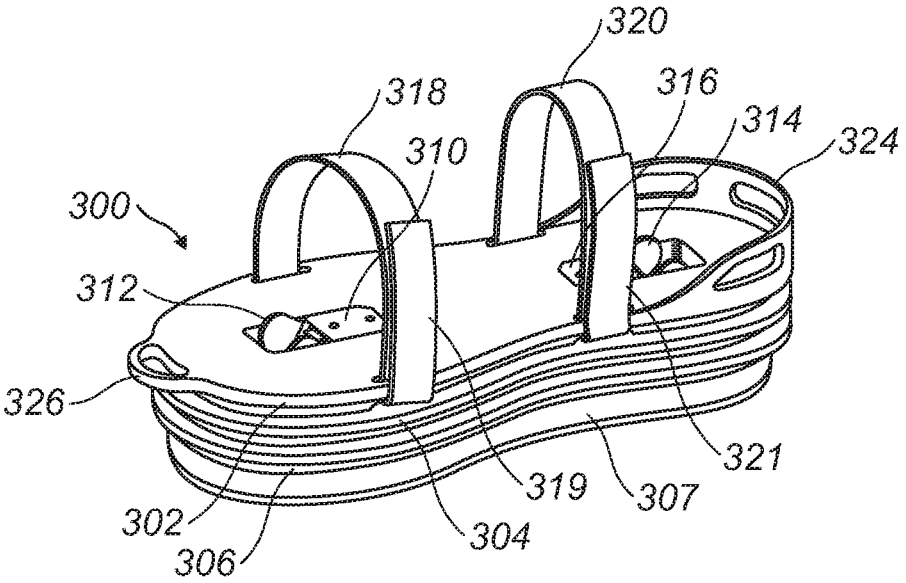
FIG. 9 is a perspective view of an assembly of another embodiment of the invention.

Referring to FIG. 9, the assembly 300 consists, in one embodiment, of a top platform 302 and bottom platform 306, and optional platform 304. The top platform has a heel support 324 and an optional carabiner toe hook, 326 to hang the assembly when not in use. There are straps 318, 319, 320, and 321 to strap the assembly to a user's foot. As shown, the straps may be connected (adjusted) by a hoop-and-loop strap connector such as Velcro™. The straps are illustrative and serve to secure a foot or shoe to the top platform while being easily releasable. Other means for so securing the platforms to a foot are within the scope of the invention. For example, the top platform may be fitted with a fabric structure like a fabric athletic shoe or a sandal. In one aspect, the top may be like an athletic shoe or a sandal with a top platform replacing the sole. It is also possible to simply attach an athletic shoe or a sandal to the top surface of the top platform and provide an opening for the latch sets.

Figure 10:
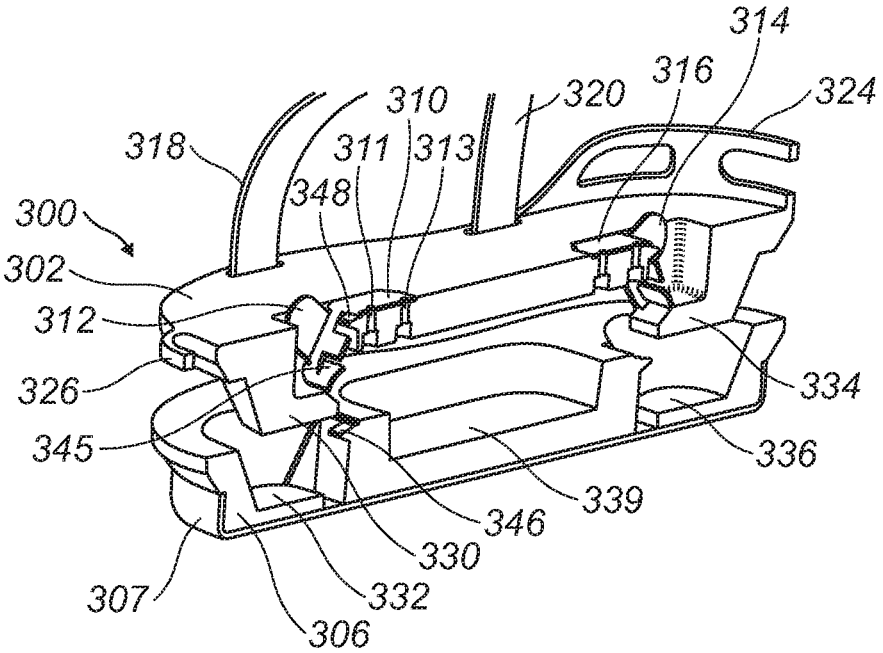
FIG. 10 is a perspective view of top and bottom components of an embodiment of the invention with platforms in an unnested position.
Figure 11:
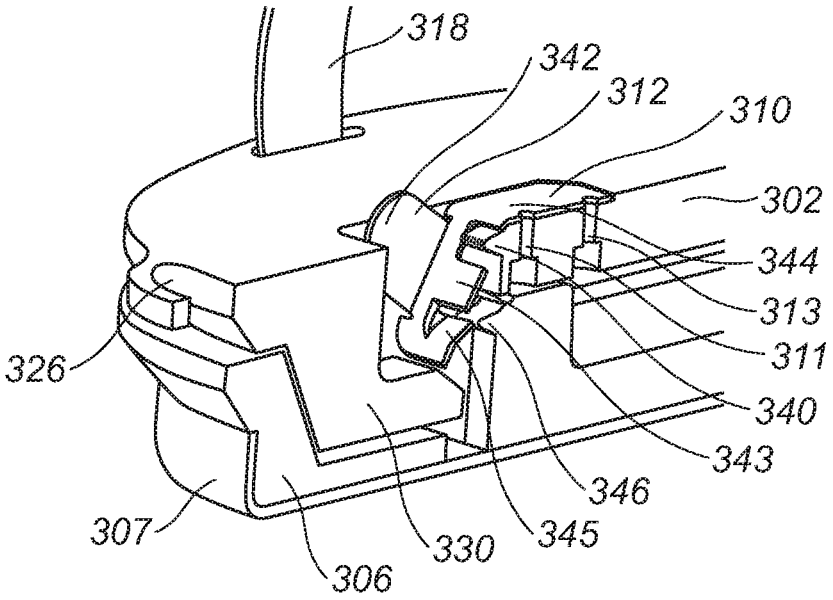
FIG. 11 is a perspective view of front top and bottom components of an embodiment of the invention with platforms in a nested position.
Figure 12:
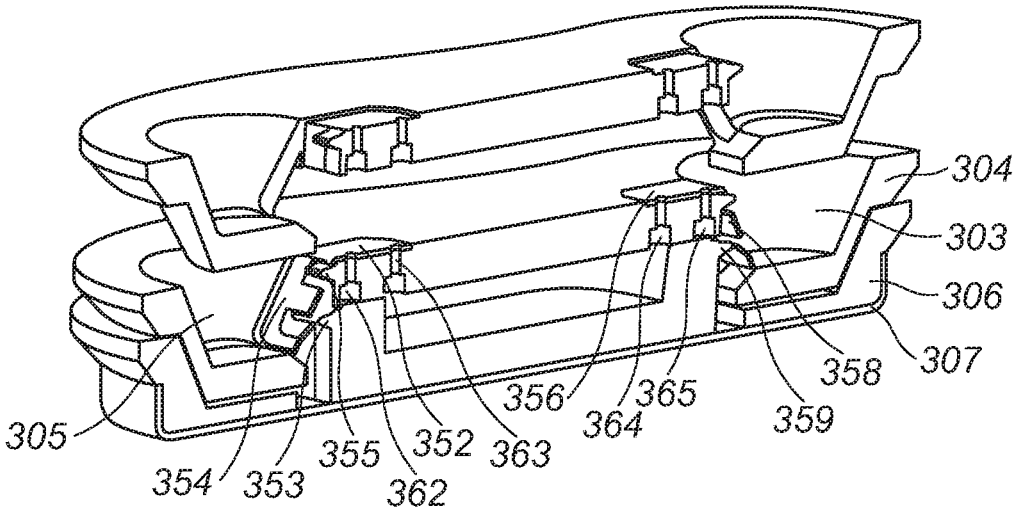
FIG. 12 is a perspective view of components of intermediate platforms of an embodiment of the invention.

The platforms are tapered from top to bottom and have a lip around the top edge as shown in the FIGS. 10, 11, and 12, and the bottom platform has an opening, 332 (intermediate platform has similar opening 305) that is sized to mate with the tapered bottom of the top (or next above intermediate platform). This allows the platforms to be nested together as shown in FIGS. 9, 10, 11, and 12. The bottom side of the top platform (and intermediate platforms) has an L-shaped projection 330 to allow latching. In general, the platforms (top, bottom and intermediate) will weigh about 3-8 pounds, with 4-6 pounds being preferred.

There are two latch sets, front, 310, 312, and rear, 314, 316, each set in the rectangular opening in the surface of the top and intermediate platforms. These are more clearly shown in FIG. 11. In general, the center of the front rectangular latch set opening will be about 15 to 35% of the length from the front end of the platform opening, and the rear latch set opening about 15 to 35% of the length from the rear end of the platform. A distance from both front and rear opening to the front and rear of the platform of about 25% is optimal. The latch is a structure angled approximately in half, with the top side, 310, solid and the bent side, 343 slotted as shown. The bottom of two slots is angled inward to form a kind of tab. There is an upward projection, 342, on the right side of the slotted bent section. There are springs (leaf or coil) inserted in openings 311 and 313 (and the similar opening in the rear latch sets). The latch is angled with an activation projection on the top side and slots that engage shaped prongs (or projections), 346, on a recess, 311, 313, in the bottom platform, 306, or intermediate platforms, 304. The latch is configured so that when there is no pressure on the latch mechanism (as when there is not a foot or another platform resting on it), the spring pushes it into an up position, releasing the latch to the prongs in the platform below (as is shown in position in FIG. 9). When the user stacks weight platforms, or places his/her toot or shoe on the top platform, it pushes down the projection, 342, and causes the latches (coupling mechanism) of the weights below it to latch-projection, 346. Conversely, when the top most platform is removed, the two platforms below it become decoupled. For example, when a user stands on the top platform, 302, the coupling latch will be depressed, causing it to rotate underneath the retention lip of the platform below, thereby locking the two platforms together. When the user removes the foot straps and steps oft the platform, the coupling mechanism will spring out from underneath the overhang and the platforms will decouple. The configuration of the coupling latch is better shown in FIG. 11.

Intermediate platforms (304 of FIG. 12) that will be pa laced between the top and bottom platform to add additional weight, are configured like the top platform 302 without the heel support 324 or hanging carabiner, 326. An immediate platform, 304 is illustrated in FIG. 12, with openings 305, 303, to allow nesting with a platform above utilizing the latch mechanisms 352,354,364, 358. The latching projections, 355, 359, on the platform below are also shown. The spring openings 362, 363, 364, and 365 are illustrated. This configuration allows the intermediate platform to be nested between the top and bottom platforms. FIG. 9 shows an assembly with one intermediate platform 304 nested between top 302 and bottom 306 one or more intermediate platforms may be used as desired.

The surface of the top platform may be coated with a protective material or may have a pad of flexible and/or elastomeric material for sanitation and protection. The pad may be permanently attached, removably attached (as with releasable adhesive), or loose. It will be shaped like the top side of the top platform but will have an opening to expose the latch opening of the top platform.

The underside of the bottom platform may be coated with an elastomer or other protective material such as polyvinyl chloride (vinyl), polypropylene, polyurethane or poly-silicone. It may alternatively have a sleeve of similar material fitted around the underside.

The top, immediate, and bottom platforms are desirably made from relatively heavy materials such as steel, cast iron, heavy polymers such as polyurethane. Cast iron is very acceptable. Polymer such as polyurethane may be made heavier by dispersing metal particle, or metal pellets in the polymer mix.

The method of use of the shoes of the invention is similar to the use of other weighted-shoes or ankle weights. The shoe is used primarily for core exercises such as leg raises and other variations of having legs suspended in the air as well as abductor exercises. They will also be used for leg isolation exercises such as leg extensions and leg curls and will function as weights for pull ups.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded as illustrative rather than as restrictive. Therefore, the scope of the invention should be limited only by the appended claims.

The invention claimed is:

1. A weighted exercise shoe assembly comprising:

(1) a top platform;

(2) a bottom platform; and (3) an adjustable latch system comprising at least one latch in the top platform and at least one latch-receiving prong in the bottom platform; and wherein:

(a) each of both the top platform and the bottom platform: (i) have an approximate shape of a sole of a human shoe, and (ii) have a toe end and a heel end, and a top side, a bottom side, a top edge, a front, and a rear;

(b) the adjustable latch system connects the top platform and the bottom platform together when a user depresses the top platform or when the platforms are stacked, thereby causing the at least one latch to depress and connect with the at least one latch-receiving prong;

(c) a back heel support is located at the heel end of the top platform and extending upwards from the top side thereof; and (d) the top platform is provided with an adjustable means to attach the top platform to a user's foot or shoe and to remain attached thereto during exercises when the user's foot or shoe is suspended.

2. The weighted exercise shoe assembly of claim 1 wherein: (i) both the platforms are each tapered inward from the top side to the bottom side such that the top side is broader and the bottom side is narrower, (ii) both the platforms each have an outwardly-projecting lip around the top edge, and (iii) the bottom platform has an opening that is sized to receiving and mate with the tapered bottom side of the top platform.

3. The weighted exercise shoe assembly of claim 1 wherein the at least one latch is an angled structure with: (i) an approximately horizontal top side and an angled side, (ii) an upward projection from the angled side, (iii) has at least one spring disposed beneath the approximately horizontal top side, and (iv) has at least one slot in the angled side adapted to engage at least one latch-receiving prong located in the bottom platform, or in a next lower intermediate platform, when the top platform is stacked thereon.

4. The weighted exercise shoe assembly of claim 2 further comprising:

(4) at least one intermediate platform disposed between the top platform and the bottom platform; wherein the intermediate platform:

(i) is tapered from a broader top side to a narrower bottom side such that the intermediate platform mates into at least one of: the top side of the bottom platform, and a top side of a lower intermediate platform, (ii) has an outwardly-extending lip around a top edge of the intermediate platform, (iii) has an opening in a top side that is sized to receive at least one of: the tapered bottom side of the top platform, and a tapered bottom side of an upper intermediate platform, and (iv) has a latch system that interlocks with at least one of: the latches of the top platform, the latch-receiving prong of the bottom platform, a latch system of a lower intermediate platform, and a latch system of an upper intermediate platform.

5. The weighted exercise shoe assembly of claim 1 wherein the top platform has means to releasably attach the top platform to a user's foot or shoe.

6. The weighted exercise shoe assembly of claim 1 wherein the top platform has a top surface and the bottom platform has an underside and wherein both the top surface of the top platform and underside of the bottom have at least one of: a protective coating, a pad, and a sleeve.

* * * * *